United States Patent [19]

Printz

[11] Patent Number: 4,809,435

[45] Date of Patent: Mar. 7, 1989

[54] EATING UTENSIL

[76] Inventor: Gerald L. Printz, 18A Northtown Rd., Jackson, Miss. 39236

[21] Appl. No.: 139,131

[22] Filed: Dec. 23, 1987

Related U.S. Application Data

[63] Continuation of Ser. No. 865,408, May 21, 1986, abandoned.

[51] Int. Cl.[4] ..... A47J 43/28

[52] U.S. Cl. ..... 30/142; 30/322; 294/99.2; D7/148

[58] Field of Search ..... 30/142, 322–325; 294/16, 99.2; D7/105, 148, 149, 137

[56] References Cited

U.S. PATENT DOCUMENTS

| | | | |
|---|---|---|---|
| 27,802 | 4/1860 | Hills | D7/112 |
| Des. 53,903 | 10/1919 | Grier | D7/103 |
| Des. 143,431 | 10/1945 | Lapin | D7/149 |
| 174,646 | 3/1876 | Truner et al. | D7/112 |
| Des. 203,455 | 1/1966 | Bruns | D7/105 |
| Des. 233,398 | 10/1974 | Lee | 294/99.2 X |
| Des. 242,760 | 12/1976 | Jensen | D7/3 |
| Des. 269,060 | 5/1983 | Creamer | D7/149 |
| 274,694 | 3/1883 | Badger | 294/99.2 X |
| 274,695 | 4/1883 | Badger | 294/99.2 |
| 277,531 | 5/1883 | Ackermann | 294/99.2 X |
| 3,640,561 | 2/1972 | Law | 294/16 |
| 3,889,995 | 6/1975 | Lin | 294/16 |
| 3,892,435 | 7/1975 | Huey | 294/16 |
| 3,937,510 | 2/1976 | Lew | 294/16 |
| 4,199,180 | 4/1980 | Kelly | 294/33 |
| 4,425,711 | 1/1984 | Wood et al. | 30/324 |

*Primary Examiner*—Douglas D. Watts
*Attorney, Agent, or Firm*—Gregory W. Carr

[57] ABSTRACT

An eating utensil (10) which, when used, resembles chopsticks, but which does not require the skilled manipulation of chopsticks. The utensil (10) includes a pair of handles (12 and 14) resembling chopsticks that converge toward their distal ends (16 and 18), where they are secured to a food-engaging member (20), such as fork tines, a spoon, or other Western-style utensil. The food-engaging member (20) may be detachably secured to the handles (12 and 14), to allow replacement of the handles of the food-engaging member if any of such components should break, and to allow substitution of a variety of types of food-engaging members, such as forks or spoons, as desired.

5 Claims, 1 Drawing Sheet

EATING UTENSIL

CROSS-REFERENCE TO RELATED APPLICATIONS

This application is a continuation of application Ser. No. 06/865,408, filed May 21, 1986, now abandoned.

TECHNICAL FIELD

The invention relates to eating utensils and, more particularly, to a utensil that resembles chopsticks, but which does not require the manipulation of chopsticks.

BACKGROUND AND SUMMARY

It is a custom in the United States and elsewhere to eat Oriental foods, such as Chinese and Japanese foods, with utensils native to that part of the world, known as chopsticks. Chopsticks are generally a matching pair of rods several inches long. Unlike Western-style utensils, such as the spoon and fork, chopsticks must be manipulated carefully by the user with one hand to grasp and carry food to the user's mouth. To accomplish this task, the user must be able to both hold the chopsticks firmly between the fingers of one hand and manipulate the chopsticks between a grasping position, where the distal ends of the chopsticks are brought together to grasp food, and an open position, where the distal ends are moved apart to release food. Thus, chopsticks work in tweezer-like fashion to grasp and hold food.

Unfortunately, the use of chopsticks requires a great deal of dexterity, making their use impossible by those without training, and often making their use undesirable by those who do not use them regularly, but who do not wish to risk the embarassment of dropping or otherwise mishandling the food they are eating. Moreover, even skilled users of chopsticks may have difficulty when eating rice, noodles and other foods, due to the tweezer-like manner in which chopsticks grasp such foods. Accordingly, those wishing to avoid embarrassment while eating often must break with Oriental custom by opting for the less-embarrassing and less enjoyable alternative of using Western-style utensils when eating Oriental cuisine.

These disadvantages are overcome by the present invention, which provides an eating utensil that, when used, resembles chopsticks, but which does not require the skilled manipulation of chopsticks. The utensil includes a pair of elongate handles that converge toward their distal ends, where they are secured to a food-engaging member, such as fork tines, a spoon or other Western-style utensil. The food-engaging member may be detachably secured to the handles, to allow replacement of the handles or the food-engaging member if any of such components should break, or to allow substitution of a variety of types of food-engaging members, such as forks or spoons, as desired.

BRIEF DESCRIPTION OF DRAWINGS

A more complete understanding of the invention can be had by reference to the following Detailed Description in conjunction with the accompanying Drawings wherein.

DETAILED DESCRIPTION

Figure 1:
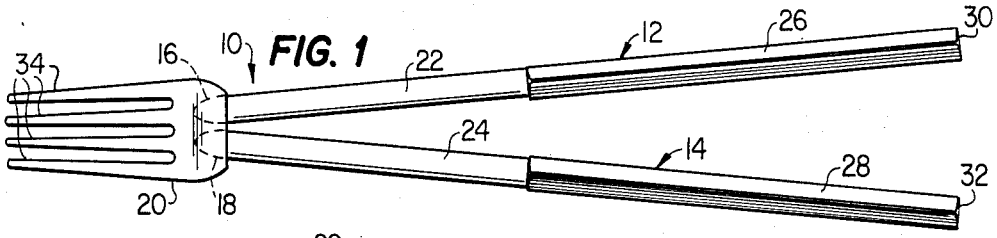
FIG. 1 is a top view of a utensil incorporating a first embodiment of the invention, wherein the food-engaging member includes fork tines.

Referring now to the Drawings, FIG. 1 shows a utensil 10 comprising a first embodiment of the invention. The utensil 10 includes a pair of handle members 12 and 14 secured at their distal ends 16 and 18 to a food-engaging member 20. The handles 12 and 14 and the food-engaging member 20 may be manufactured from plastic, metal, wood or other suitable materials.

The handles 12 and 14 are designed as a matching set, to resemble a pair of chopsticks. Portions 22 and 24 of the handles 12 and 14 adjacent their respective distal ends 16 and 18 have a generally curved surface tapering in diameter toward the distal ends 16 and 18, to facilitate gripping and manipulating the utensil 10 with one hand and to give the appearance of chopsticks. The handles 12 and 14 include portions 26 and 28 adjacent their proximal ends 30 and 32 having rectangular cross-sections and generally larger diameters than the portions 22 and 24 adjacent the distal ends 16 and 18. It will be apparent that the portions 26 and 28 of the handles 12 and 14 may have virtually any cross-section desired to resemble chopsticks, including various multi-sided or polygonal configurations. The handles 12 and 14 of the utensil 10 may be held with one hand, in a manner similar to the way in which chopsticks are held, to lift food from a plate or bowl, for example, to the user's mouth.

The handles 12 and 14 are also preferably sufficiently flexible or resilient to be bent together so that their proximal ends 30 and 32 are brought together in tweezer-like fashion. This allows the utensil 10 to be used as a pair of tongs to pick up articles with its proximal ends 30 and 32.

Food is engaged and held by the food-engaging member 20 of the utensil 10. The member 20 comprises a set of fork tines 34 which are directed by the user as is a conventional fork to lift or skewer food. It will be apparent that various types of fork tines may be utilized in the present invention, including sets of 1, 2, 3, 4, 5, etc., tines of varying lengths and widths, and tines of various widths and shapes.

Figure 2:
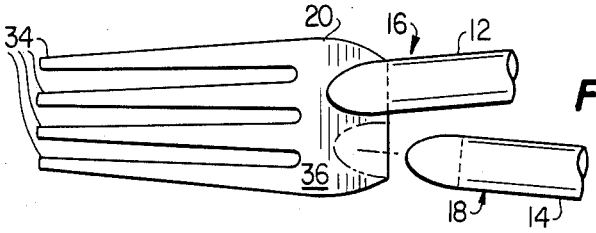
FIG. 2 is an enlarged partial bottom view of the portion of the utensil shown in FIG. 1, adjacent the food-engaging member.

FIG. 2 illustrates the manner in which the distal ends 16 and 18 of the respective handles 12 and 14 are secured to the food-engaging member 20. The upper surface of each of the distal ends 16 and 18 of the handles 12 and 14 is contoured to mate with the lower surface 36 of the food-engaging member 20. The mating surfaces of the food-engaging member 20 and the distal ends 16 and 18 of the handles 12 and 14 are bonded together by glue, adhesive or other suitable means.

Figure 3:
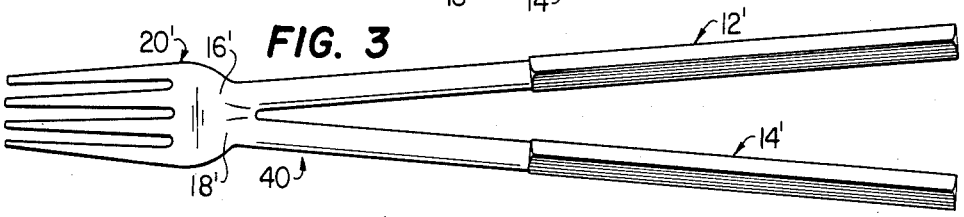
FIG. 3 is a top view of a utensil incorporating a second embodiment of the invention.
Figure 4:
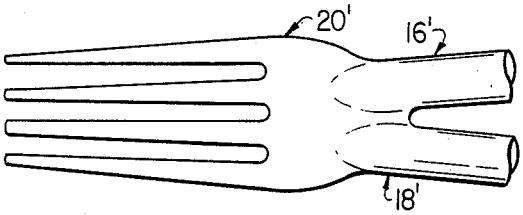
FIG. 4 is an enlarged partial bottom view of the portion of the utensil shown in FIG. 3, adjacent its food-engaging member.

FIGS. 3 and 4 illustrates an eating utensil 40 comprising a second embodiment of the invention incorporating numerous component parts which are substantially identical in construction and function to component parts of the utensil 10 illustrated in FIGS. 1 and 2. Such identical parts are designated by the same reference numerals utilized in the description of trailer 10, but are differentiated therefrom by means of a prime (') designation. The embodiment of FIGS. 3 and 4 is primarily distinguishable from the embodiment of FIGS. 1 and 2 in that the handles 12' and 14' in the food-engaging member 20' of the utensil 40 form an integral unit. Thus, the utensil 40 can be easily manufactured, for example, from a single piece of molded plastic, wood, cast metal or the like.

Figure 5:
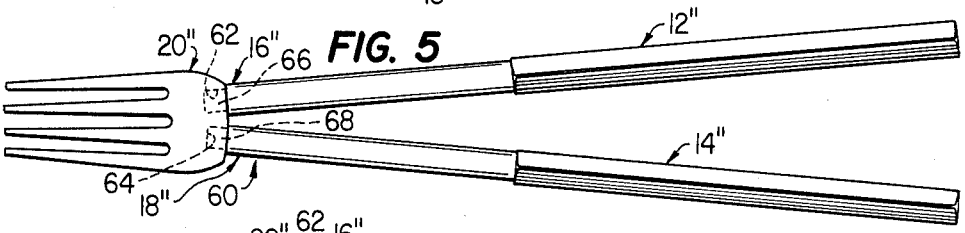
FIG. 5 is a top view of a utensil incorporating a third embodiment of the invention.
Figure 6:
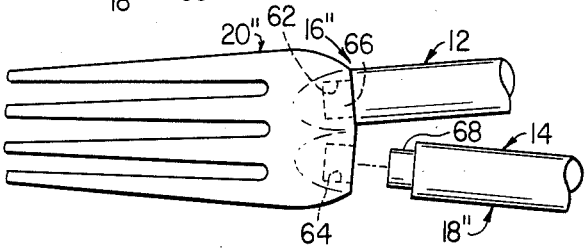
FIG. 6 is an enlarged partial bottom view of the utensil shown in FIG. 5 adjacent its food engaging member.

FIGS. 5 and 6 illustrate a utensil 60 comprising a third embodiment of the invention incorporating numerous component parts which are also substantially identical in construction and function to component parts of the utensil 10 illustrated in FIGS. 1 and 2. Such identical parts are designated by the same reference numerals utilized in the description of the utensil 10, but are differentiated therefrom by means of a double prime (") designation.

The embodiment shown in FIGS. 5 and is primarily distinguishable from the embodiment shown in FIGS. 1 and 2 in that the utensil 60 incorporates fastening means for releasably securing the handles 12" and 14" to the food-engaging member 20". This is accomplished by providing the food-engaging member 20" with a pair of cylindrical sockets 62 and 64 sized suitably to tightly receive cylindrically-shaped inserts 66 and 68 extending from the respective distal ends 16" and 18" of the handles 12 and 14. The extensions 66 and 68 are held within their respective receptacles 62 and 64 by a friction fit when inserted, and may be removed from the sockets 62 and 64 merely by pulling the handles 12 and 14 from the engaging member 20". Alternatively, the inserts 66 and 68 may be permanently secured within the sockets 62 and 64 by means of glue, adhesive, or other suitable means.

The embodiment of FIGS. 5 and 6, or a similar arrangement allowing detachment of the handles 12" and 14" from the food-engaging member 20", facilitates replacement of any such component that is broken. In addition, such an arrangement allows the food-engaging member 20" to be replaced with virtually any other type of food-engaging member, such as a soup spoon, dessert spoon, salad fork tines, and the like, depending upon the particular type of food to be eaten.

Although particular embodiments of the invention have been illustrated in the accompanying Drawings and described in the foregoing Detailed Description, it will be understood that the invention is not limited to the embodiments disclosed, but is capable of numerous rearrangements, modifications and substitutions of parts and elements without departing from the spirit of the invention.

I claim:

1. An eating utensil comprising:

a first chopstick, having distal and proximal ends;

a second chopstick, having distal and proximal ends;

a food-engaging member secured directly to the distal ends of the first and second chopsticks; and the handle members being spaced apart at their proximal ends and converging together at their juncture with the food-engaging member, to resemble chopsticks holding food wherein the first and second chopsticks include a gripping portion adjacent its distal end for hand manipulation.

2. The eating utensil of claim 1 further comprising means for releasably securing the first and second chopsticks to the food-engaging member.

3. The eating utensil of claim 2 wherein the food-engaging member comprises fork tines.

4. The eating utensil of claim 1 wherein each chopstick includes a second portion adjacent its proximal end having a diameter generally larger than that of the gripping portion.

5. The eating utensil of claim 4 wherein the cross-section of the second portion of each has at least three sides.

* * * * *